US006410140B1

(12) United States Patent
Land et al.

(10) Patent No.: US 6,410,140 B1
(45) Date of Patent: Jun. 25, 2002

(54) FIRE RESISTANT CORESPUN YARN AND FABRIC COMPRISING SAME

(75) Inventors: Frank J. Land, Island Park, NY (US); Alan C. Handermann, Asheville, NC (US)

(73) Assignees: BASF Corporation, Enka; McKinnon-Land, LLC, Charlotte, both of NC (US)

( * ) Notice: Subject to any disclaimer, the term of this patent is extended or adjusted under 35 U.S.C. 154(b) by 0 days.

(21) Appl. No.: 09/710,893

(22) Filed: Nov. 14, 2000

Related U.S. Application Data

(63) Continuation-in-part of application No. 09/406,732, filed on Sep. 28, 1999, now Pat. No. 6,146,759.

(51) Int. Cl.[7] ..... D01F 6/00

(52) U.S. Cl. ..... 428/377; 428/370; 57/707; 57/210; 57/238; 57/244; 57/245

(58) Field of Search ..... 428/370, 373, 428/377; 57/207, 210, 238, 244, 245

(56) References Cited

U.S. PATENT DOCUMENTS 3,366,001 A 1/1968 Meserole (List continued on next page.)

FOREIGN PATENT DOCUMENTS

| | | |
|---|---|---|
| GB | 1 593 048 | 7/1981 |
| JP | 57-59585 | 4/1982 |
| JP | 58-100323 | 6/1983 |
| JP | 60-107608 | 6/1985 |
| JP | 61-261330 | 11/1985 |
| JP | 1-141041 | 6/1989 |

OTHER PUBLICATIONS

International Search Report issued in Application No. PCT/US00/22956, dated Nov. 17, 2000.

International Search Report issued in Application No. PCT/US01/29282, dated Dec. 28, 2001.

Dictionary of Fiber & Textile Technology, Hoechst Celanese, pp. ii, iii, v, 34 and 35, 1990.

*Primary Examiner*—N. Edwards

(74) *Attorney, Agent, or Firm*—Burns, Doane, Swecker & Mathis, L.L.P.

(57) ABSTRACT

Provided is a fire resistant corespun yarn. The yarn includes a core of high temperature resistant continuous inorganic filaments; a first sheath of staple fibers surrounding the core, wherein the staple fibers comprise fibers of at least one fire resistant material selected from the group consisting of meta-aramids, para-aramids, fluoropolymers and copolymers, chloropolymers and copolymers, polybenzimidazole, polyimides, polyamideimides, partially oxidized polyacrylonitriles, novoloids, poly (p-phenylene benzobisoxazoles), poly (p-phenylene benzothiazoles), polyphenylene sulfides, flame retardant viscose rayons, polyvinyl chloride homopolymers and copolymers, polyetheretherketones, polyketones, polyetherimides, polylactides, and combinations thereof; and a second sheath of staple fibers surrounding the first corespun yarn. This yarn may be woven and knit in fine, non-plied or plied form and extends the range of fineness of fabrics below heretofore achievable limits. Also provided is a fire resistant fabric which includes a fire resistant fabric substrate formed from the fire resistant corespun yarn, as well as a product upholstered with the fire resistant fabric.

28 Claims, 1 Drawing Sheet

U.S. PATENT DOCUMENTS 3,439,491 A 4/1969 Scruggs
3,572,397 A 3/1971 Austin
3,729,920 A * 5/1973 Sayers et al. ..... 57/144
3,828,544 A * 8/1974 Alker ..... 57/152
3,886,015 A 5/1975 Turner
3,913,309 A 10/1975 Chiarotto
4,024,700 A 5/1977 Drummond
4,263,777 A * 4/1981 Wada et al. ..... 57/227
4,299,884 A 11/1981 Payen
4,331,729 A 5/1982 Weber
4,381,639 A 5/1983 Kress
4,497,167 A 2/1985 Nakahara et al.
4,500,593 A 2/1985 Weber
4,502,364 A 3/1985 Zucker et al.
4,534,262 A * 8/1985 Swenson ..... 57/210
4,541,231 A * 9/1985 Graham, Jr. et al. ..... 57/12
4,551,887 A 11/1985 Uematsu
4,640,179 A * 2/1987 Cameron ..... 57/210
4,670,327 A 6/1987 Weber
4,718,225 A 1/1988 Sanagi
4,868,041 A 9/1989 Yamagishi et al.
4,921,756 A * 5/1990 Tolbert et al. ..... 428/377
4,927,698 A * 5/1990 Jaco et al. ..... 428/373
4,936,085 A * 6/1990 Kolmes ..... 57/229
4,958,485 A * 9/1990 Montgomery et al. ..... 57/210
5,496,625 A 3/1996 Lilani
5,540,980 A 7/1996 Tolbert et al.
5,597,649 A * 1/1997 Sandor et al. ..... 428/370
5,688,594 A * 11/1997 Lichscheidt et al. ..... 428/370
5,849,648 A 12/1998 Kent et al.
5,891,813 A 4/1999 Gadoury
6,146,759 A 11/2000 Land
6,240,716 B1 * 6/2001 Yanagawase et al. ..... 57/2
6,287,690 B1 11/2001 Land

* cited by examiner

FIRE RESISTANT CORESPUN YARN AND FABRIC COMPRISING SAME

CROSS-REFERENCE TO RELATED APPLICATIONS

This application is a continuation-in-part of U.S. application Ser. No. 09/406,732, filed Sep. 28, 1999, now U.S. Pat. No. 6,146,759.

BACKGROUND OF THE INVENTION

1. Field of the Invention

The invention relates to a fire resistant yarn and to a method of preparing a fire resistant yarn. The invention also relates to a fabric which includes the fire resistant yarn. The invention has particular applicability in the formation of fire resistant fabrics for applications such as upholstery, mattress and pillow ticking, bed spreads, pillow covers, draperies or cubicle curtains, wallcoverings, window treatments, awning covers and baby clothing.

2. Description of the Related Art

It is well known in the textile industry to produce fire resistant fabrics for use as upholstery, mattress ticking, panel fabric and the like, using yarn formed of natural or synthetic fibers, and then treating the fabric with fire retarding chemicals. Conventional fire retarding chemicals often include halogen-based and/or phosphorus-based chemicals. Unfortunately, such treated fabric is heavier than similar types of non-fire retardant fabrics, and further has a limited wear life. Also, this type of fabric typically melts or forms brittle chars which break away when the fabric is burned, and exposes the foam of a composite chair, mattress or panel fabric system. The exposed foam then acts as a fuel source.

It is also known to form fire resistant fabrics of fire resistant, relatively heavy weight yarns in which a low temperature resistant fiber is ring spun around a core of continuous filament fiberglass. However, this type of ring spun yarn has torque imparted thereto during the spinning process and is very lively. Because of the lively nature of the yarn, it is necessary to ply "S" and "Z" ring spun yarns together so that the torque and liveliness in the yarn is balanced in order to satisfactorily weave or knit the yarn into the fabric, without experiencing problems of tangles occurring in the yarn during the knitting or weaving process. This plying of the "S" and "Z" yarns together results in a composite yarn which is so large that it cannot be used in the formation of fine textured, lightweight fabrics. In some instances, the fiberglass filaments in the core protrude through the natural fiber sheath. It is believed that the problem of protruding core fibers is associated with the twist, torque and liveliness being imparted to the fiberglass core during the ring spinning process.

It is the current practice to produce coated upholstery fabrics by weaving or knitting a substrate or scrim of a cotton or cotton and polyester blend yarn. This scrim is then coated with a layered structure of thermoplastic polyvinyl halide composition, such as polyvinyl chloride (PVC). This coated upholstery fabric has very little, if any, fire resistance and no flame barrier properties. In addition to the coating chemical having a limited shelf life, the chemical coatings are disadvantageous in that they pose a safety hazard in case of contact with skin.

SUMMARY OF THE INVENTION

To overcome or conspicuously ameliorate the disadvantages of the related art, it is an object of the present invention to provide a novel fire resistant corespun yarn.

It is a further object of the invention to provide a fire resistant fabric which includes the fire resistant corespun yarn in a fire resistant fabric substrate.

It is a further object of the invention to provide a product upholstered with the fire resistant fabric.

The corespun yarn can advantageously be used in forming fine textured or non-textured fire resistant decorative fabrics. Upon exposure to flame and high heat, sheathings of staple fibers surrounding and covering a core become charred and burnt, yet remain in position around the core to create a thermal insulation barrier. The char effectively can block the flow of oxygen and other gases, preventing the fabric from igniting.

In addition, the fabrics woven or knit with the corespun yarn of the present invention can advantageously be dyed and printed with conventional dying and printing materials. These fabrics are particularly suitable for forming fine textured fire resistant flame barrier decorative fabrics for use in upholstery, panel fabrics, mattress and pillow ticking, draperies or cubicle curtains, wallcoverings, window treatments and baby clothing.

In accordance with one aspect of the invention, a fire resistant corespun yarn is provided. The corespun yarn comprises a core of high temperature resistant continuous inorganic filaments, a first sheath of staple fibers surrounding the core, wherein the staple fibers comprise fibers of at least one fire resistant material and a second sheath of staple fibers surrounding the first corespun yarn. Advantageously, a blend of two different fire resistant fibers are provided in the first sheath, one which is effective to char and remain dimensionally stable when exposed to open flame, and a second which releases oxygen depleting gases to extinguish the burning non-flame-resistant fiber in the second sheath.

In accordance with a further aspect of the invention, a fire resistant corespun yarn is provided. The corespun yarn comprises:

- a core of high temperature resistant continuous inorganic filaments;
- a first sheath of staple fibers surrounding the core, wherein the staple fibers comprise fibers of at least one fire resistant material selected from the group consisting of meta-aramids, para-aramids, fluoropolymers and copolymers, chloropolymers and copolymers, polybenzimidazole, polyimides, polyamideimides, partially oxidized polyacrylonitriles, novoloids, poly (p-phenylene benzobisoxazoles), poly (p-phenylene benzothiazoles), polyphenylene sulfides, flame retardant viscose rayons, polyvinyl chloride homopolymers and copolymers, polyetheretherketones, polyketones, polyetherimides, polylactides, and combinations thereof; and
- a second sheath of staple fibers surrounding the first corespun yarn.

Preferably, the continuous inorganic filaments are selected from the group consisting of fiberglasses, carbons, ceramics, quartzes, steels, and combinations thereof, and the core has a structure which includes low temperature resistant synthetic continuous filaments selected from the group consisting of nylons, polyesters and polyolefins such as polyethylene and polypropylene, two-plied with the inorganic filament core.

In accordance with a further aspect of the invention, provided is a fire resistant corespun yarn, comprising:

- a two-plied core of continuous inorganic filaments selected from the group consisting of fiberglasses, carbons, ceramics, quartzes, steels and combinations thereof, and low temperature resistant synthetic continuous filaments selected from the group consisting of nylons, polyesters, and polyolefins;

a first sheath of staple fibers surrounding the core, wherein the staple fibers comprise fibers of at least one fire resistant material selected from the group consisting of meta-aramids, para-aramids, fluoropolymers and copolymers thereof, chloropolymers and copolymers thereof, polybenzimidazole, polyimides, polyamideimides, partially oxidized polyacrylonitriles, novoloids, poly (p-phenylene benzobisoxazoles), poly (p-phenylene benzothiazoles), polyphenylene sulfides, flame retardant viscose rayons, polyvinyl chloride homopolymers and copolymers thereof, polyetheretherketones, polyketones, polyetherimides, polylactides, and combinations thereof; and a second sheath of staple fibers surrounding the first corespun yarn, wherein the first sheath of staple fibers has a Limiting Oxygen Index of at least 22 as measured by ASTM D 2863.

In accordance with yet another aspect of the invention, a fire resistant fabric is provided. The fabric includes a fire resistant fabric substrate, which includes the fire resistant corespun yarn.

In accordance with yet another aspect of the invention, a product upholstered with the fire resistant fabric is provided. The product can advantageously be free of a fire resistant coating and of a barrier fabric.

Other objects, advantages and aspects of the present invention will become apparent to one of ordinary skill in the art on a review of the specification, drawings and claims appended hereto.

BRIEF DESCRIPTION OF THE DRAWINGS

The objects and advantages of the invention will become apparent from the following detailed description of the preferred embodiments thereof in connection with the accompanying drawings, in which like numerals designate like elements, and in which.

DETAILED DESCRIPTION OF PREFERRED EMBODIMENTS OF THE INVENTION

Figure 1:
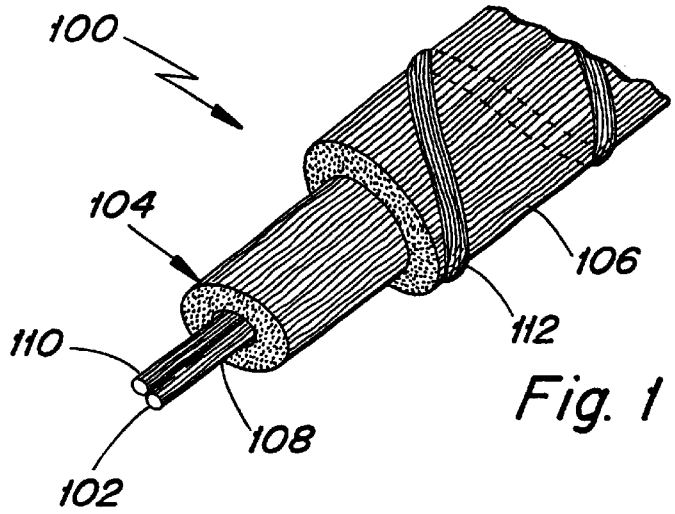
FIG. 1 is an enlarged view of a fragment of the balanced double corespun yarn in accordance with the present invention.

Preferred embodiments of the invention will now be described with reference to FIG. 1, which illustrates an exemplary fire resistant multi-corespun yarn in accordance with one aspect of the invention. While the exemplary fire resistant yarn is a balanced double corespun yarn, it should be clear that triple or more corespun yarns are also envisioned.

The basic structure of the yarn 100 in accordance with the invention includes a filament core 102 completely surrounded by a first sheath 104, and a second sheath 106 completely surrounding the first sheath 104.

Core 102 is formed from high temperature resistant continuous inorganic filaments 108, preferably two-plied with low temperature resistant synthetic continuous filaments 110. The inorganic filament material is preferably selected from the group consisting of fiberglasses, carbons, ceramics, quartzes, steels, and combinations thereof. Suitable continuous filament materials for use in the core 102 are commercially available. The core 102 is preferably from about 15 to 35% by weight based on the total weight of the corespun yarn, and the inorganic portion 108 of the filament core is preferably from about 10 to 30% by weight of the total weight of the double corespun yarn.

Preferably, synthetic filaments 110 are formed of a synthetic (i.e., man made) material selected from the group consisting of a nylons, polyesters, polyolefins such as polyethylene and polypropylene, and combinations thereof. Of these, nylons and polyesters are particularly preferred. Suitable continuous synthetic filaments are commercially available, for example, continuous filament nylon from BASF. Synthetic filaments 110 are preferably from about 5 to 25% by weight of the total weight of the double corespun yarn 100. While a two-plied core structure has been exemplified, it should be clear that other multi-plied core structures can be used.

First sheath 104 is a medium to high temperature staple fiber or staple fiber blend, preferably having a Limiting Oxygen Index (LOI) of at least 22 (as measured by ASTM D 2863). Upon exposure to flame and high heat, a first sheath having an LOI in that range can effectively self-extinguish in air, becoming charred and burnt. The first sheath thus helps to form a lattice system over the inorganic grid of the core, thereby preventing burning fibers of the second sheath or other outer sheaths from burning materials beneath the fabric. The lattice/gridwork system can effectively block the flow of oxygen and the penetration of flame from igniting the materials beneath the fabric, while helping to self-extinguish the burning second or other outer sheath fibers on the surface of the fabric.

The first sheath 104 is preferably from about 5 to 40% by weight of the total weight of the double corespun yarn 100. The staple fibers of the first sheath comprise fibers of at least one fire resistant material selected from the following:

Fire resistant fibers such as melamine, for example, that sold under the tradename BASOFIL by BASF; meta-aramnids such as poly(m-phenylene isophthalamide), for 15 example, those sold under the tradenames NOMEX by E. I. Du Pont de Nemours and Co., TEIJINCONEX by Teijin Limited and FENYLENE by Russian State Complex; para-aramids such as poly(p-phenylene terephthalamide), for example, that sold under the tradenaine KEVLAR by E. I. Du Pont de Nemours and Co., poly(diphenylether paraaramid), for example, that sold under the tradename TECHNORA by Teijin Limited, and those sold under the tradenames TWARON by Acordis and FENYLENE ST (Russian State Complex); fluoropolymers such as polytetrafluoroethylene (PTFE), for example, those sold under the tradenames TEFLON TFE by E. I. Du Pont de Nemours and Co., LENZING PTFE by Lenzing A. G., RASTEX by W.R. Gore and Associates, GORE-TEX by W. R. Gore and Associates, PROFILEN by Lenzing A. G. and TOYOFLON PTFE by Toray Industries Inc., poly(ethylene-chlorotrifluoroethylene) (E-CTFE), for example, those sold under the tradenames HALAR by Albany International Corp. and TOYOFLON E-TFE by Toray Industries Inc., polyvinylidene fluoride (PVDF), for example, those sold under the tradenames KYNAR by Albany International Corp. and FLORLON (Russian State Complex), polyperfluoroalkoxy (PFA), for example, those sold under the tradenames TEFLON PFA by E. I. Du Pont de Nemours and Co. and TOYOFLON PFA by Toray Industries Inc., polyfluorinated ethylene-propylene (FEP), for example, that sold under the tradename TEFLON FEP by E. I. Du Pont de Nemours and Co.; polybenzimidazole such as that sold under the tradename PBI by Hoechst Celanese Acetate LLC, polyimides, for example, those sold under the tradenames P-84 by Inspec Fibers and KAPTON by E. I. Du Pont de Nemours and Co.; polyamideimides, for example, that sold under the tradename KERMEL by Rhone-Poulenc; partially oxidized polyacrylonitriles, for example, those sold under the tradenames FORTAFIL OPF by Fortafil Fibers Inc., AVOX by Textron Inc., PYRON by Zoltek Corp., PANOX by SGL Technik, THORNEL by American Fibers and Fabrics and PYROMEX by Toho Rayon Corp.; novoloids, for example, phenol-formaldehyde novolac, for example, that sold under the tradename KYNOL by Gun Ei Chemical Industry Co.; poly (p-phenylene benzobisoxazole) (PBO), for example, that sold under the tradename ZYLON by Toyobo Co.; poly (p-phenylene benzothiazoles) (PBT); polyphenylene sulfide (PPS), for example, those sold under the tradenames RYTON by American Fibers and Fabrics, TORAY PPS by Toray Industries Inc., FORTRON by Kureha Chemical Industry Co. and PROCON by Toyobo Co.; flame retardant viscose rayons, for example, those sold under the tradenames LENZING FR by Lenzing A. G. and VISIL by Kemira Fibres Oy; polyvinyl chloride homopolymers and copolymers, for example, those sold under the tradenames VINYON HH, RHOVYL by Rhovyl S. A., CLEVYL, THERMOVYL by Rhovyl S. A., FIBRAVYL by Rhovyl S. A., RETRACTYL by Rhovyl S. A., PIVIACID, ISOVYL by Rhovyl S. A., VICLON by Kureha Chemical Industry Co., TEVIRON by Teijin Ltd., CORDELAN, ENVILON Toyo Chemical Co. and VICRON, made in Korea; modacrylics, for example, those sold under the tradenames PROTEX by Kaneka and SEF by Solutia; chloropolymers and copolymers such as polyvinylidene chloride copolymers, for example, those sold under the tradenames SARAN by Pittsfield Weaving, KREHALON by Kureha Chemical Industry Co. and OMNI-SARAN by Fibrasomni, S. A. de C. V.; polyetheretherketones (PEEK), for example, that sold under the tradename ZYEX by Zyex Ltd.; polyketones (PEK), for example, that sold under the tradename ULTRAPEK by BASF; polyetherimides (PEI), for example, that sold under the tradename ULTEM by General Electric Co.; polylactides such as those available from Cargill Dow Polymers; and combinations thereof.

The first sheath can include additional fiber types which can be blended with the fire resistant fibers. These additional fibers may include non-flame-resistant fibers, for example, cottons, wools, nylons, polyesters, polyolefins, rayons, acrylics, silks, mohair, cellulose acetate, polyvinyl alcohols (PVA), for example, those sold under the tradenames CREMONA by Kuraray, KURALON by Kuraray, KURALON KII by Kuraray, MEWLON by Unitika Chemical Co., NITI-VELON by Nitivy Company Ltd., SOLVRON by Nitivy Company Ltd. and VILON by Nitivy Company Ltd., polyethylene napththalates, for example, that sold under the tradename PENTEX by Honeywell, and combinations thereof.

Second sheath 106 is a low to medium temperature chopped staple fiber sheath surrounding the core 102 and first sheath 104 (i.e., the first core spun yarn) to create the product double sheath corespun yarn 100. The low to medium temperature resistant staple fibers of the second sheath 106 are preferably selected from a variety of different types of either natural (e.g., vegetable, mineral or animal) or synthetic fibers, such as cottons, wools, nylons, polyesters, polyolefins, rayons, acrylics, silks, mohair, cellulose acetate, polylactides such as those available from Cargill Dow Polymers, or blends of such fibers. Of these, the preferred low to medium temperature resistant staple fibers are cottons or polyolefins. The second sheath 106 is preferably from about 35% to 80% of the total weight of the double corespun yarn 100.

The two-plied continuous inorganic filaments and synthetic filaments 108, 110 of the core 102 extend generally longitudinally in an axial direction of the double corespun yarn 100. The majority of the staple fibers of the first sheath 104 and of the second sheath 106 extend around core 102 in a slightly spiraled direction. A minor portion, for example, from about 35 to 80%, of the staple fibers of each of the sheaths form a binding wrapper spirally around the majority of the staple fibers, as indicated at 112, in a direction opposite the majority of staple fibers. The first sheath 104 hence surrounds and completely covers the two-plied core 102, and the second sheath 106 surrounds and completely covers the first sheath 104. The outer surface of the double corespun yarn has the appearance and general characteristics of the low to medium temperature resistant fibers forming the second sheath 106.

The size of the product yarn will vary depending on the final application of the yarn and the particular fabric characteristics desired, but is preferably within the range of from about 30/1 to 1/1 conventional cotton count, preferably from about 21/1 to 5/1 conventional cotton count.

The product multi-corespun yarn is balanced and has very little if any torque or liveliness. This characteristic allows the yarn to be woven or knitted in single end manner without the need for two ends to be plied to balance the torque. As a result, fine textured fabrics can be formed having heat resistant properties which have not been possible to date.

Figure 2:
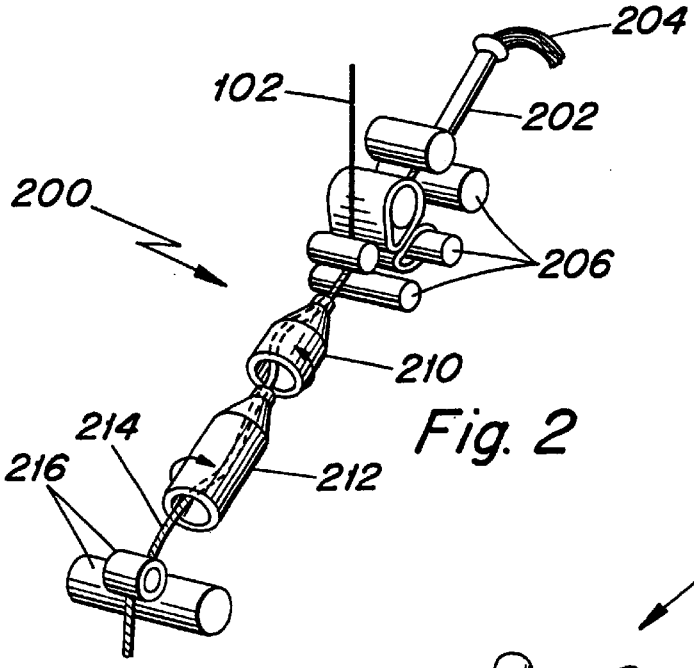
FIG. 2 is a schematic diagram of an air jet spinning apparatus of the type utilized in forming the fine denier corespun yarn and double corespun yarn of the present invention.

A method for forming an exemplary double corespun yarn 100 in accordance with the invention will now be described with reference to FIG. 2. While the yarn has a two-plied core and a blend of two staple fibers in the first sheath, it should be clear that this example is exemplary and in no way limitative. As pointed out above, the double corespun yarn 100 of the present invention is preferably produced on an air jet spinning apparatus 200 of the type illustrated. Such an apparatus is commercially available, for example, from Murata of America, Inc., and is described in the literature. See, e.g., U.S. Pat. Nos. 5,540,980, 4,718,225, 4,551,887 and 4,497,167, the entire contents of which patents are incorporated herein by reference.

The air jet spinning apparatus 200 includes an entrance trumpet 202 into which a sliver of medium to high temperature resistant staple fibers 204 is fed. Staple fibers 204 are then passed through a set of paired drafting rolls 206. High temperature resistant continuous inorganic filament and low temperature synthetic continuous filament two-plied core 102 is fed between the last of the paired drafting rolls 206 and onto the top of the staple fibers 204.

The two-plied core 102 and staple fibers 204 then pass through a first fluid swirling air jet nozzle 210, and a second fluid swirling air jet nozzle 212, thereby forming a first corespun yarn 214. The first and second airjet nozzles 210, 212 are constructed to produce swirling fluid flows in opposite directions, as indicated by the arrows. The action of first air jet nozzle 210 causes the staple fibers 204 to be wrapped or spiraled around the two-plied core 102 in a first direction. The oppositely operating air jet nozzles 210, 212 causes a minor portion, for example, from about 5 to 20%, of the staple fibers to separate and wind around the unseparated staple fibers in a direction opposite the majority fiber spiral. The wound staple fibers maintain the first sheath 104 in close contact surrounding and covering the two-plied core 102. The first corespun yarn 214 is then drawn from the second nozzle 212 by a delivery roll assembly 216 and is wound onto a take-up package (not shown).

The same air jet spinning apparatus can be utilized to apply the second sheath 106 to the first corespun yarn 214 in the same manner described above, thereby forming the double corespun yarn 100. In this instance, the low to medium temperature resistant staple fibers of the second sheath 106 are fed through the entrance trumpet 202, and the first corespun yarn 214 is passed through the set of paired drafting rolls 206. The same spiraling action achieved for the first sheath is obtained for the second sheath staple fibers around the first sheath by way of the oppositely operating air jet nozzles 210, 212. The second corespun yarn is then drawn from the second nozzle 212 by the delivery roll assembly 216 and is wound onto the take-up package.

Since the formation of the present yarn on an air jet spinning apparatus does not impart excessive liveliness and torque to the two-plied inorganic filament/synthetic fiber core, no problems are experienced with loose and broken ends of the inorganic filament/synthetic fiber core protruding outwardly through the first sheath and or the second sheath in the yarn and the fabrics produced therefrom. Since it is possible to produce woven and knitted fabrics utilizing single ends of double corespun yarn, the double corespun yarn can be woven into fine textured fabrics with the double corespun yarn being in the range of from about 30/1 to 1/1 conventional cotton count. This extends the range of fineness of the fabrics which can be produced relative to the types of fabrics heretofore possible to produce by utilizing only double corespun yarns of the prior art.

Figure 3:
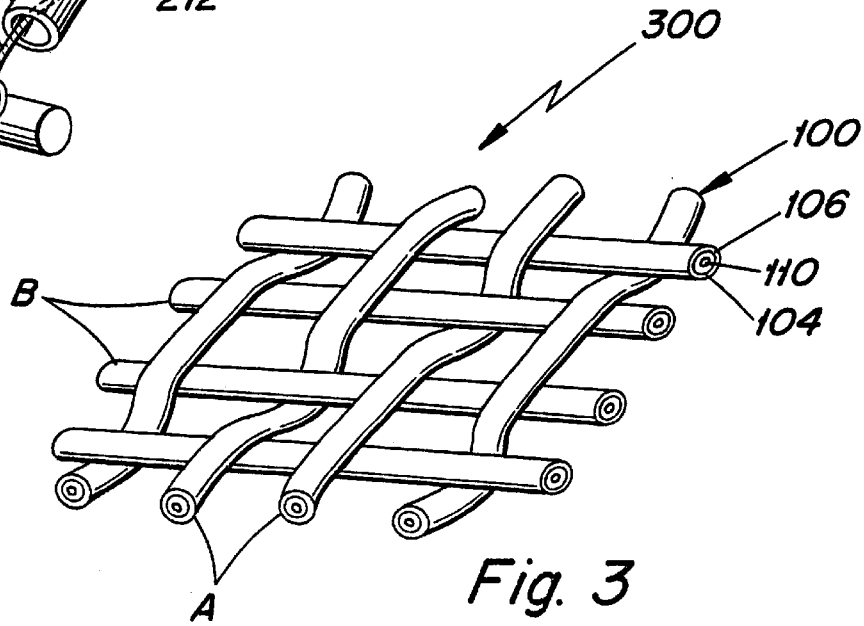
FIG. 3. is a fragmentary isometric view of a portion of a woven fabric in accordance with invention.

The flame resistant multi-corespun yarns described above can advantageously be used in forming fine textured fire resistant barrier decorative fabrics for numerous applications, such as upholstery, mattress and pillow ticking, bed spreads, pillow covers, draperies or cubicle curtains, wallcoverings, window treatments, awning covers and baby clothing. FIG. 3 illustrates an enlarged view of a portion of an exemplary woven decorative fabric 300 in a two up, one down, right-hand twill weave design. In this exemplified embodiment, the above-described flame retardant multi-corespun yarn is employed for warp yarns A. The material for the filling yarn can be the same or different from that of the warp yarn, depending on the second sheathing material. For purposes of illustration, an open weave is shown to demonstrate the manner in which the warp yarns A and the filling yarns B are interwoven. However, the actual fabric can be tightly woven. For example, the weave can include from about 10 to 200 warp yarns per inch and from about 10 to 90 filling yarns per inch.

While FIG. 3 illustrates a two up, one down, right-hand twill weave design, the described multi-corespun yarns can be employed in any number of designs. For example, the fabric can be woven into various jacquard and doubly woven styles.

Fabrics formed with the described yarns have the feel and surface characteristics of similar types of upholstery fabrics formed of 100% polyolefin fibers while having the desirable fire resistant and flame barrier characteristics not present in upholstery fabric formed entirely of polyolefin fibers. In this regard, the fabrics formed in accordance with the invention preferably meet one or more of various standard tests designed to test the fire resistancy of fabrics. For example, one standard test for measuring the fire resistant characteristics of fabrics is Technical Bulletin, California 133 Test Method (Cal. 133), the entire contents of which are herein incorporated by reference. According to this test, a composite manufactured chair upholstered with a fabric to be tested is exposed to an 80 second inverted rectangular Bunsen burner flame. Fabrics employing the above-described fire resistant multi-spun yarns having gone through this test remain strong and intact, exhibiting no fabric shrinkage. Additional tests which the formed fabrics meet include the proposed Consumers Product Safety Commission (CPSC) Proposed Flammability Code, British Standard 5852, Technical Bulletin, California 129 Test Method (Cal. 129), the Component Testing on Chair Contents (Britain, France, Germany and Japan) and the Component Testing on Manufactured Chair (Britain, France, Germany and Japan).

When fabrics which have been formed of the balanced double corespun yarn of the present invention are exposed to flame and high heat, the first and second sheaths 104, 106 of staple fibers surrounding and covering the core are charred and burned but remain in position around the core 102 to create a thermal insulation barrier. The inorganic filament core and part of the first sheath 104 remain intact after the organic staple fiber materials from the second sheath 106 have burned. They form a lattice/gridwork system upon which the char remains, thereby blocking the flow of oxygen and penetration of flame through the fabric while providing a structure which maintains the integrity of the fabric after the organic materials of the staple fiber first and second sheaths have been burned and charred. Unlike known fabrics, chemical treatment of the sheath or fabric fibers is not required because the composite multi-corespun yarn is inherently flame resistant. Non-flame retardant coatings may, however, be applied to the surface or backing of the fabric to form a more dimensionally stable fabric depending on the end product use or composite fabric and product application.

Fabrics woven or knit of the double corespun yarn of the present invention may be dyed and printed with conventional dying and printing materials and methods since the outer surface characteristics of the yarn and the fabric formed thereof are determined by the second sheath of low to medium temperature resistant staple fibers surrounding the first sheath and covering the core.

The following non-limiting examples are set forth to further demonstrate the formation of fire resistant multi-corespun yarns. These examples also demonstrate that fire resistant fabrics can be formed from these multi-corespun yarns.

EXAMPLES

Example 1

A continuous filament fiberglass was two-plied with a continuous nylon fiber to form a core for the yarn. The fiberglass of the core was ECD 225 1/0 (equivalent to 198 denier) sold by PPG, and the nylon was 20 denier 8 filament (equivalent to a 172 conventional cotton count) from BASF. The core fiber materials had a weight such that the core accounted for 25% by weight of the overall double spun yarn weight. The two-plied core was fed between the paired drafting rolls 206 of the air jet spinning apparatus illustrated in FIG. 2. At the same time, a blended sliver of medium to high temperature resistant modacrylic (Protex® (M))/melamine (BASF Basofil®) fibers was fed into the entrance end of the entrance trumpet 202 to form a first corespun yarn. The blended modacrylic/melamine sliver had a weight of 45 grains per yard, and a modacrylic/melamine fiber blend of 50/50% by weight, which was obtained by a Truetzschler multi-blending, carding and drawing process. The modacrylic/melamine fibers had a weight such that the first sheath accounted for 25% by weight of the overall double spun yarn weight. The first corespun yarn had a conventional cotton yarn count of 20.

A second sheath material consisted of a 100% polyolefin sliver having a weight of 45 grains per yard and a denier of 532. The polyolefm fibers had a weight such that the second sheath accounted for 50% by weight of the overall yarn weight. These fibers were fed into the entrance end of the entrance trumpet 202. At the same time, the first corespun yarn having a weight necessary to account for 50% by weight of the overall double spun yarn weight was fed between the paired drafting rolls 206. A double corespun yarn was thereby formed. The double corespun yarn achieved by this air jet process had a 10/1 conventional cotton count.

Example 2

A continuous filament fiberglass was two-plied with a continuous nylon fiber to form a core for the yarn. The fiberglass of the core was ECD 450 1/0 (equivalent to 98 denier) sold by PPG, and the nylon was 20 denier 8 filament (equivalent to a 172 conventional cotton count) from BASF. The core fiber materials had a weight such that the core accounted for 25% by weight of the overall double spun yarn weight. The two-plied core was fed between the paired drafting rolls 206 of the air jet spinning apparatus illustrated in FIG. 2. At the same time, a blended sliver of medium to high temperature resistant modacrylic (Protex® (M))/melamine (BASF Basofil®) fibers was fed into the entrance end of the entrance trumpet 202 to form a first corespun yarn. The blended modacrylic/melamine sliver had a weight of 45 grains per yard, and a modacrylic/melamine fiber blend of 50/50 by weight, which was obtained by a Truetzschler multi-blending, carding and drawing process. The modacrylic/melamine fibers had a weight such that the first sheath accounted for 25% by weight of the overall double spun yarn weight. The first corespun yarn had a conventional cotton yarn count of 30.

A second sheath material consisted of a 100% polyolefin sliver having a weight of 45 grains per yard and a denier of 532. The polyolefin fibers had a weight such that the second sheath accounted for 50% by weight of the overall yarn weight. These fibers were fed into the entrance end of the entrance trumpet 202. At the same time, the first corespun yarn having a weight necessary to account for 50% by weight of the overall double spun yarn weight was fed between the paired drafting rolls 206. A double corespun yarn was thereby formed. The double corespun yarn achieved by this air jet process had a 15/1 conventional cotton count.

Example 3

The double corespun samples resulting from Examples 1 and 2 were each employed as the filling yarn in the woven process to form a respective fabric sample as illustrated in FIG. 3. The fabrics had 90 warp yarns per inch and 40 filling yarns per inch. The double corespun yarn had a 10/1 conventional cotton count in the filling and a 15/1 conventional cotton count in the warp to form an 8.5 ounce per square yard, two up, one down, right-hand twill weave fabric.

The fabrics were subjected to the standard test described in Technical Bulletin, California 133 Test Method (Cal. 133). The fabrics were each found to remain flexible and intact, exhibiting no brittleness, melting, or fabric shrinkage. The second sheath of polyolefin fibers was burnt and charred. However, the charred portions remained in position surrounding the core and the first sheath. These results indicate that the two-plied core and first sheath effectively provide a thermal insulation barrier and limited movement of vapor through the fabric, while, in addition, the fiberglass/synthetic core and the first sheath modacrylic/melamine blend also provide a grid system, matrix or lattice which prevents rupture of the upholstery fabric and penetration of the flame through the upholstery fabric and onto the material of which the chair was formed.

While the invention has been described in detail with reference to specific embodiments thereof, it will be apparent to one skilled in the art that various changes and modifications can be made, and equivalents employed, without departing from the scope of the appended claims.

What is claimed is:

1. A fire resistant corespun yarn, comprising:

a core of high temperature resistant continuous inorganic filaments;

a first sheath of staple fibers surrounding the core, wherein the staple fibers comprise fibers of at least one fire resistant material selected from the group consisting of meta-aramids, para-aramids, fluoropolymers and copolymers thereof, chloropolymers, polybenzimidazole, polyimides, polyamideimides, partially oxidized polyacrylonitriles, novoloids, poly (p-phenylene benzobisoxazoles), poly (p-phenylene benzothiazoles), polyphenylene sulfides, flame retardant viscose rayons, polyvinyl chloride homopolymers and copolymers thereof, polyetheretherketones, polyketones, polyetherimides, polylactides, and combinations thereof; and a second sheath of staple fibers surrounding the first sheath.

2. The fire resistant corespun yarn according to claim 1, wherein the staple fibers of the first sheath surrounding the core further comprise fibers of at least one material selected from the group consisting of cottons, wools, nylons, polyesters, polyolefins, rayons, acrylics, silks, mohairs, cellulose acetates, polyvinyl alcohols, polyethylene napththalates, and combinations thereof.

3. The fire resistant corespun yarn according to claim 1, wherein the first sheath of staple fibers has a Limiting Oxygen Index of at least 22 as measured by ASTM D 2863.

4. The fire resistant corespun yarn according to claim 1, wherein the inorganic filaments of the core are of a material selected from the group consisting of fiberglasses, carbons, ceramics, quartz, steels, and combinations thereof.

5. The fire resistant corespun yarn according to claim 1, wherein the core has a multi-ply structure.

6. The fire resistant corespun yarn according to claim 5, wherein the multi-ply structure comprises low temperature resistant synthetic continuous filaments selected from the group consisting of polyolefins, nylons and polyesters, two-plied with the inorganic filaments.

7. The fire resistant corespun yarn according to claim 1, wherein the second sheath staple fibers are of a material selected from the group consisting of cottons, wools, nylons, polyesters, polyolefins, rayons, acrylics, silks, mohairs, cellulose acetates, polylactides, and blends thereof.

8. The fire resistant corespun yarn according to claim 7, wherein the second sheath staple fibers are cotton or polyolefin fibers.

9. The fire resistant corespun yarn according to claim 1, wherein the size of the corespun yarn is from about 30/1 to 1/1 conventional cotton count.

10. A fire resistant corespun yarn, comprising:

a two-plied core of continuous inorganic filaments selected from the group consisting of fiberglasses, carbons, ceramics, quartzes, steels and combinations thereof, and low temperature resistant synthetic continuous filaments selected from the group consisting of nylons, polyesters, and polyolefins;

a first sheath of staple fibers surrounding the core, wherein the staple fibers comprise fibers of at least one fire resistant material selected from the group consisting of meta-aramids, para-aramids, fluoropolymers and copolymers thereof, chloropolymers, polybenzimidazole, polyimides, polyamideimides, partially oxidized polyacrylonitriles, novoloids, poly (p-phenylene benzobisoxazoles), poly (p-phenylene benzothiazoles), polyphenylene sulfides, flame retardant viscose rayons, polyvinyl chloride homopolymers and copolymers thereof, polyetheretherketones, polyketones, polyetherimides, polylactides, and combinations thereof; and a second sheath of staple fibers surrounding the first sheath, wherein the first sheath of staple fibers has a Limiting Oxygen Index of at least 22 as measured by ASTM D 2863.

11. A fire resistant fabric, comprising:

a fire resistant fabric substrate, the substrate comprising:

a fire resistant corespun yarn, the yarn comprising:

a core of high temperature resistant continuous inorganic filaments;

a first sheath of staple fibers surrounding the core, wherein the staple fibers comprise fibers of at least one fire resistant material selected from the group consisting of meta-aramids, para-aramids, fluoropolymers and copolymers thereof, chloropolymers, polybenzimidazole, polyimides, polyamideimides, partially oxidized polyacrylonitriles, novoloids, poly (p-phenylene benzobisoxazoles), poly (p-phenylene benzothiazoles), polyphenylene sulfides, flame retardant viscose rayons, polyvinyl chloride homopolymers and copolymers thereof, polyetheretherketones, polyketones, polyetherimides, polylactides, and combinations thereof, and a second sheath of staple fibers surrounding the first sheath.

12. The fire resistant fabric according to claim 11, wherein the core further comprises low temperature resistant synthetic continuous filaments selected from the group consisting of nylons, polyesters and polyolefins, two-plied with the inorganic filaments.

13. The fire resistant fabric according to claim 11, wherein the second sheath staple fibers are of a material selected from the group consisting of cottons, wools, nylons, polyesters, polyolefins, rayons, acrylics, silks, mohairs, cellulose acetates, polylactides, and blends thereof.

14. The fire resistant fabric according to claim 13, wherein the core is from about 15 to 35% by weight based on the total weight of the corespun yarn, and the second sheath is from about 35 to 80% by weight based on the total weight of the corespun yarn.

15. The fire resistant fabric according to claim 11, wherein the fabric is free of a fire resistant coating.

16. A product upholstered with the fire resistant fabric of claim 11.

17. The product of claim 16, wherein the fabric is free of a fire resistant coating.

18. The product of claim 16, wherein the product is a composite chair, a mattress or a panel fabric furniture system.

19. The product of claim 16, wherein the fabric is free of a barrier fabric.

20. The product of claim 16, wherein upon exposure of the fabric to flame, the first sheath is effective to partially burn and char around the core, thereby preventing rupture and flame penetration to materials below the fabric, and to help self-extinguish the burning second sheath fibers on the surface of the fabric.

21. The fire resistant corespun yarn according to claim 1, wherein the staple fibers of the first sheath comprise fibers of at least one fire resistant material selected from the group consisting of meta-aramids, para-aramids, and combinations thereof.

22. The fire resistant corespun yarn according to claim 21, wherein the staple fibers of the first sheath comprise fibers of at least one fire resistant material selected from para-aramids.

23. The fire resistant corespun yarn according to claim 1, wherein the staple fibers of the first sheath comprise fibers of at least one fire resistant material selected from the group consisting of fluoropolymers and copolymers thereof, chloropolymers, and combinations thereof.

24. The fire resistant corespun yarn according to claim 1, wherein the staple fibers of the first sheath comprise fibers of at least one fire resistant material selected from the group consisting of polybenzimidazole, polyimides, polyamideimides, partially oxidized polyacrylonitriles, novoloids, and combinations thereof.

25. The fire resistant corespun yarn according to claim 1, wherein the staple fibers of the first sheath comprise fibers of at least one fire resistant material selected from the group consisting of poly (p-phenylene benzobisoxazoles), poly (p-phenylene benzothiazoles), polyphenylene sulfides, and combinations thereof.

26. The fire resistant corespun yarn according to claim 1, wherein the staple fibers of the first sheath comprise fibers of at least one fire resistant material selected from the group consisting of flame retardant viscose rayons, polyvinyl chloride homopolymers, copolymers thereof, and combinations thereof.

27. The fire resistant corespun yarn according to claim 1, wherein the staple fibers of the first sheath comprise fibers of at least one fire resistant material selected from the group consisting of polyetheretherketones, polyketones, polyetherimides, polylactides, and combinations thereof.

28. The fire resistant corespun yarn according to claim 4, wherein the inorganic filaments of the core are a fiberglass.

* * * * *